US007287495B1

(12) United States Patent
Rowe

(10) Patent No.: US 7,287,495 B1
(45) Date of Patent: Oct. 30, 2007

(54) TWO-CYCLE ENGINE

(76) Inventor: Philip Rowe, 439 NE Leaping Frog Way, Port St. Lucie, FL (US) 34983

( * ) Notice: Subject to any disclaimer, the term of this patent is extended or adjusted under 35 U.S.C. 154(b) by 0 days.

(21) Appl. No.: 11/477,122

(22) Filed: Jun. 29, 2006

(51) Int. Cl.
*F02B 25/00* (2006.01)

(52) U.S. Cl. ..... 123/65 VD

(58) Field of Classification Search ..... 123/65 VD, 123/190.1, 188.14, 590
See application file for complete search history.

(56) References Cited

U.S. PATENT DOCUMENTS 5,086,735 A * 2/1992 Melchior et al. ..... 123/65 VD
5,778,838 A * 7/1998 Taue ..... 123/73 B
5,819,693 A * 10/1998 Curtil ..... 123/65 E
2003/0159665 A1* 8/2003 Coney et al. ..... 123/65 VD

* cited by examiner

*Primary Examiner*—Stephen K. Cronin
*Assistant Examiner*—Jason Benton

(57) ABSTRACT

In a two cycle engine, the bypass as well as the need for mixing fuel and oil are eliminated through the use of a separate compressor. A unique set of inlet and exhaust valves form an integral part of the system. These valve are used to optimize the performance of the engine.

10 Claims, 4 Drawing Sheets

TWO-CYCLE ENGINE

BACKGROUND

1. Field

The present invention relates to two-stroke internal combustion engines and more particularly to such engines which incorporate a separate compressor.

2. Prior Art

In the vast majority of prior art two stroke engines, a mixture of air, fuel and oil is injected into the crankcase where the mixture is compressed before it is fed to the cylinder head. FIGS. 1 through 3 are diagrams of a conventional two-stroke engine, showing various positions of the cylinder during the two-stroke cycle. The upper portion of the cylinder is referred to the cylinder head area while the lower portion is referred to as the crank case area. These Figures are identical except for the position of the piston within the cylinder. From these Figures, the engine can be seen to comprise a cylinder 1, a spark plug 2, a piston 3, a connecting rod 4, a flywheel 5, a pin through the piston 6, a crankshaft 7, a bypass 8, an exhaust port 9 and an air-fuel-oil input port 15.

In the operation of this prior art engine, the piston moves up and down within the cylinder. The piston is attached to one end of the connecting rod by pin 6 while the opposite end of the connecting rod is rotatably attached to the crankshaft. The reciprocating motion of the piston is converted to rotational motion by way of the crankshaft. The crankshaft motion drives the flywheel 5. The piston can be seen to be positioned at the beginning of the up-stroke in FIG. 1. In FIG. 2, the piston has progressed farther up the cylinder, but has not reached the top of its stroke. In FIG. 3, the piston has passed the top of its stroke and is on the down strokes. As the piston starts the up-stroke, it draws into the crankcase an air-fuel-oil mixture through the input port 15. Above the piston in the cylinder area is an air-fuel-oil mixture which was forced into this area from the crankcase through the bypass during the previous cycle. The bypass is a passageway which connects the crankcase with the cylinder head. The piston can block the upper end of the bypass depending on its position within the cylinder. The position of the piston in FIG. 1 leaves unblocked both ends of the bypass 8, allowing the mixture to flow from the crankcase into the cylinder head area.

As the piston moves farther up in the cylinder, as shown in FIG. 2, the mixture in the cylinder head area is compressed. At the top of the stroke, the spark plug 2 ignites the mixture, forcing the piston down into a down or power stroke, as shown in FIG. 3. It can also be seen in FIG. 3 that on the down stroke, the piston blocks the upper end of the bypass 8 and at the same time, compresses the mixture in the crankcase area. As the piston proceeds lower, it comes to the position shown in FIG. 1 where the piston unblocks the upper end of the bypass, letting the mixture, which is now under pressure from the down stroke, flow through the bypass and enter the cylinder head area.

It can also be seen in FIG. 1 that the burnt mixture from the power stroke can escape through the exhaust port while the cylinder head area is being supplied with a fresh air-fuel-oil mixture from the crankcase. The fresh mixture from the bypass is under pressure and it aids in forcing the burnt mixture out through the exhaust port.

The advantage of a two stroke engine is it produces two power strokes within four strokes which, considered by itself, would theoretically produce double the power output of a four cycle engine having the same piston displacement; however, there are several disadvantages to the two stroke engine. One is fuel laden air is used to help purge the cylinder of fumes which invariably loses fuel through the exhaust pipe and lowers efficiency. A second disadvantage is that the lubricating oil has to be mixed with the fuel because a conventional splash lubricating system cannot be placed in the crankcase area of the cylinder. If oil, which is typically available in abundance in the crankcase area, is splashed about as is normal in a conventional lubrication system, this abundance of oil would unbalance the air-fuel-oil mixture necessary for the two stroke operation.

A number of inventions have been made to improve two stroke engines, and some have been directed at improving the lubrication system, but none have been directed at eliminating in one engine all of the shortcomings noted above. The following patents illustrated some of the prior art inventions in this area.

U.S. Pat. No. 4,206,727 illustrates a two stroke engine which has a main piston, an auxiliary piston and transfer valve arrangement with its associated drive mechanism.

U.S. Pat. No. 4,579,093 illustrates a two stroke spark ignition engine designed to eliminate the need for the typical reed valve and carburetor, and also eliminate the carbon build up inherent in the mixing of the lubricant with the fuel mixture.

U.S. Pat. No. 5,638,779 illustrates an internal combustion engine of either two stroke or four stroke construction which includes a block having at least one cylinder bore therein, having sidewalls carrying a liner of a structural fiber reinforced ceramic matric.

U.S. Pat. No. 6,478,642 illustrates an oil system for a two stroke outboard marine engine. The oil system includes a housing for the oil system which contains an inlet, an outlet and an oil return.

U.S. Pat. No. 6,513,464 illustrates a stratified two cycle engine comprising a cylinder having an upper end and a lower end, a head at the upper end and fuel and air intake ports at the lower end.

Although the prior art patents provide some improvements over the disadvantages of a two stroke engine, they do not eliminate them entirely. The specific shortcomings noted above are eliminated in the present invention which is described below.

SUMMARY

It is an object of the present invention to provide a two stroke engine with a fan that is used to provide compressed air to the engine and which allows oil to be supplied directly to the crankcase and separate from the fuel. The engine cylinder is purged with air which is free of oil, improving efficiency, fuel consumption and extending engine life.

It is an object of the present invention to provide a two stroke engine with a rolling valve plate that contains the engine's main intake and exhaust valves.

It is an object of the present invention to provide valves in the intake and exhaust lines of a two-stroke engine to optimize its performance.

The separate fan or compressor in the present inventions eliminates the need for adding oil to the fuel, making lubrication less of a problem. The intake and exhaust gases are passed through a unique rolling valve plate, allowing custom valve opening to optimize the performance of the engine.

DETAILED DESCRIPTION OF THE INVENTION

Figure 3:
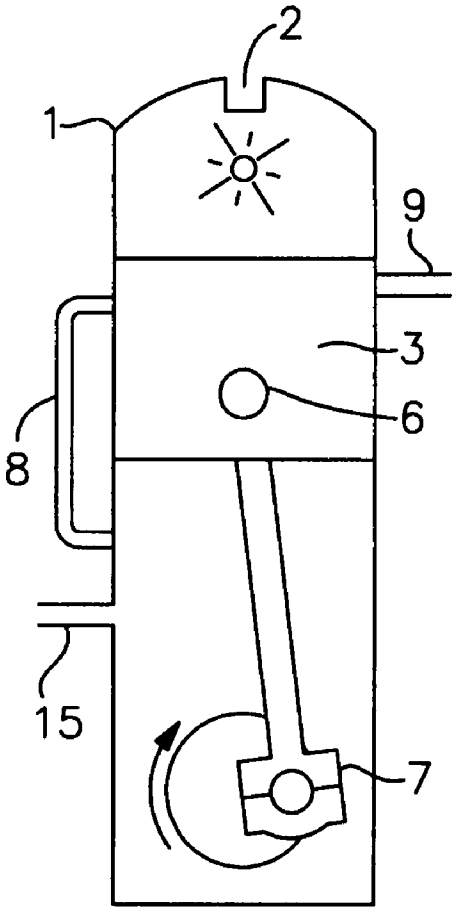
Fig. 3 (Prior Art)
FIG. 3 shows a prior art two stroke engine with the piston at the beginning of the down or power stroke.
Figure 2:
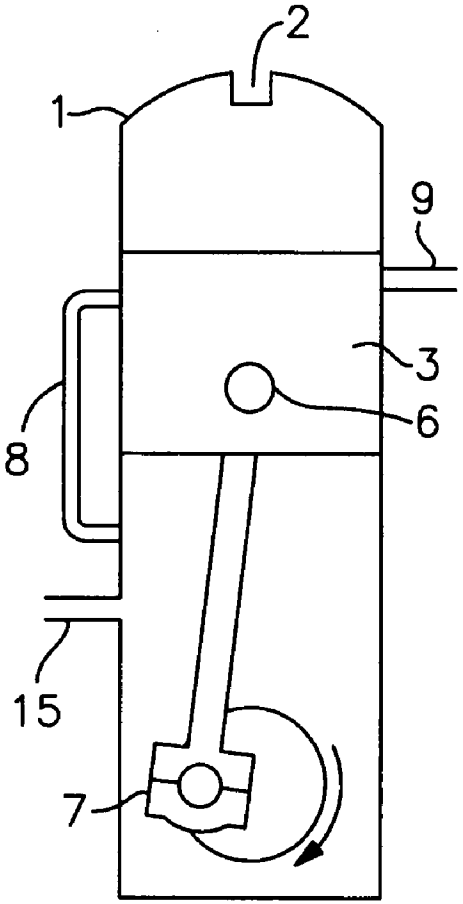
Fig. 2 (Prior Art)
FIG. 2 shows a prior art two stroke engine with the piston further along in the up stroke with the piston covering the upper end of the bypass.
Figure 1:
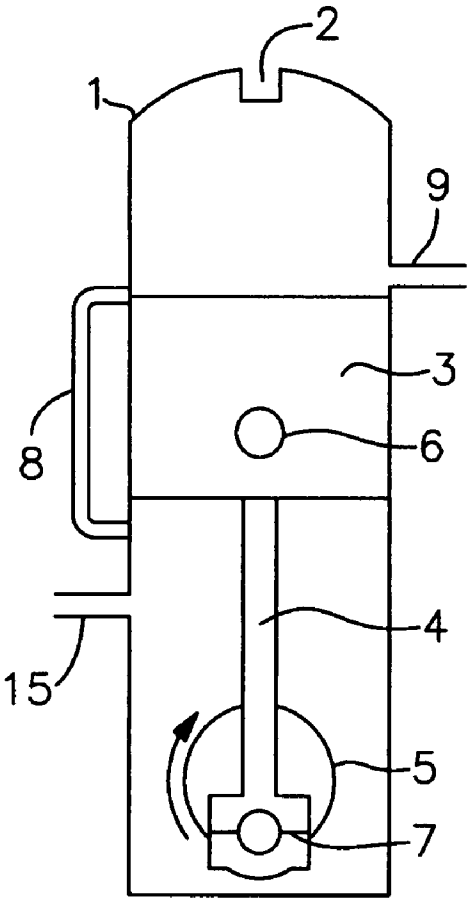
Fig. 1 (Prior Art)
FIG. 1 is a schematic drawing of a prior art two stroke engine with the piston beginning the up stroke.
Figure 4:
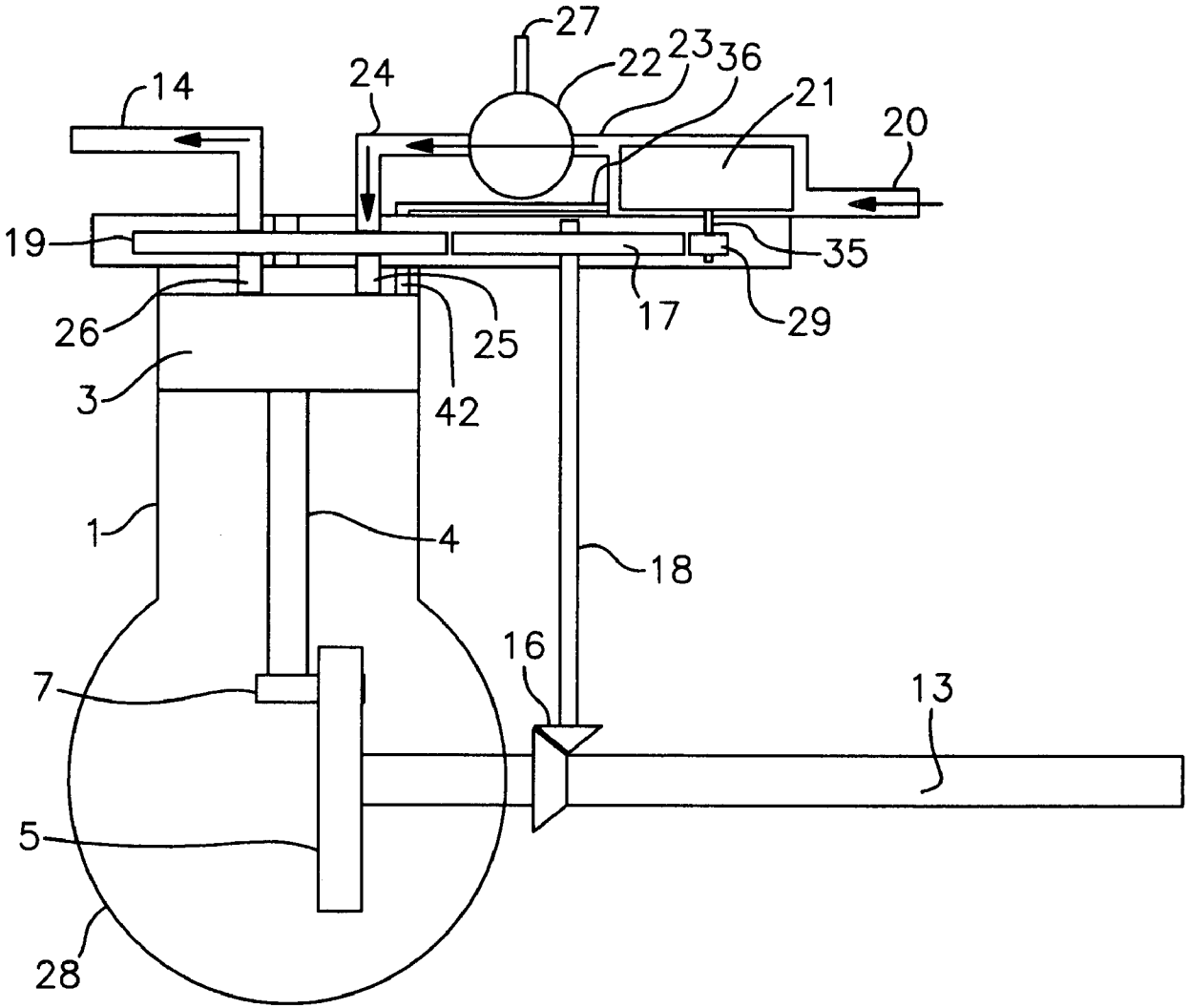
FIG. 4 is a cross sectional/schematic view of the invention showing the cylinder of the present invention connected to a fan.

FIG. 4 is a cross sectional/schematic invention which shows the basic engine parts including a cylinder 1, a piston 3, a connecting rod 4, an engine flywheel 5, a crankshaft 7, a system air intake port 20, a fan, blower or compressor 21, a rolling valve plate 19 which includes the engine's intake valve 31 and exhaust valve 30, (shown in FIG. 5) a carburetor 22 and a system exhaust port 14. The principal component differences between the present invention and the prior art, are the addition of the fan 21 and the elimination of the bypass and the air-fuel-oil input port.

A principal operating difference between the present invention and the prior art is the air-fuel mixture produced in the carburetor is injected under pressure from the fan directly into the cylinder head to eliminate the need to compress this mixture in the crank case or feed it through the bypass to the cylinder head. In the present invention, the fan 21 is added and is driven by a mechanical linkage to the engine crankshaft. The linkage comprises the fan shaft 35, the fan gear 29, the timing gear 17, the bevel gears 16. Fan 21 takes in outside air, through system intake port 20 compresses it and then supplies it through a line 23, carburetor 22, line 24 and rolling intake valve 31 to the cylinder head. The exhaust path from the engine is also through the rolling exhaust valve 30 to the systems exhaust port 14. The rolling valves are a unique feature of this invention and are explained in more detail in connection with the description of FIG. 5.

Figure 5:
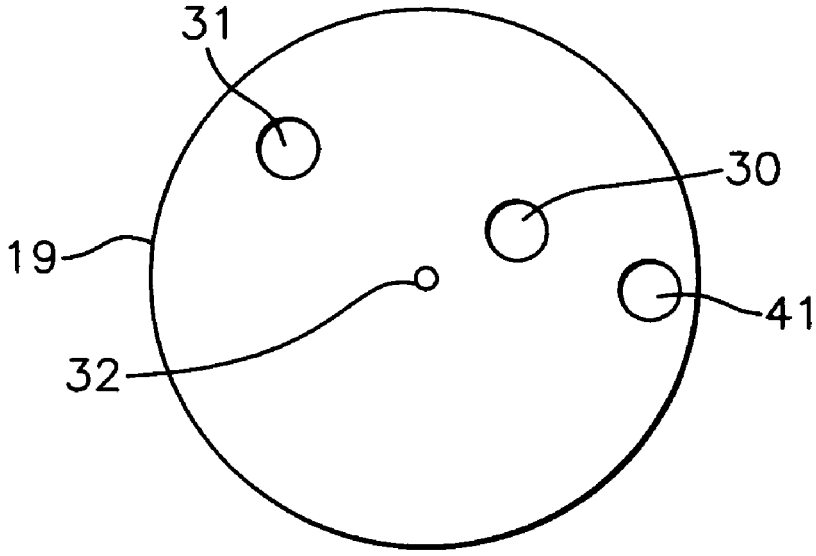
FIG. 5 is a plan view of the rolling valves.

As can be seen in FIG. 5, the rolling plate 19 contains the input port 31 and the exhaust port 30. This plate is caused to rotate by way of a power take off from the drive shaft 13. The drive shaft is connected to the flywheel and derives its rotative power from the engine. The power take off is shown in FIG. 4 to be a set of bevel gears 16 connecting a timing gear shaft 18 to the drive shaft. The timing gear shaft 18 is connected at its upper end to the timing gear 17. The rotation of the drive shaft causes the timing gear shaft and the timing gear to rotate. The outer edge of the timing gear contains gear teeth which mesh with mating gear teeth of the outer edge of the rolling valve plate 19, causing it to rotate.

The timing gear is connected to the drive shaft 13 by way of shaft 18 and bevel gears 16, causing the timing gear to rotate as a function of the engine speed. That arrangement forces the timing gear and the plate 19 to be at a known position with respect to the values at each point in the engines cycle, admitting purging air and the air fuel mixture when required and removing exhaust fumes when required. The time that these valve openings and closings as required are listed in Table I below:

| PISTON POSITION | PURGE | INTAKE | EXHAUST |
|---|---|---|---|
| Beginning down stroke | CLOSED | CLOSED | CLOSED |
| End of down stroke | OPEN | CLOSED | OPEN |
| Beginning of upstroke | CLOSED | OPEN | CLOSED |
| End of upstroke | CLOSED | CLOSED | CLOSED |

The general timing for opening and closing these valves is shown in Table II. These time and the duration of opening are optimized for each engine. The optimum times referred to here in and in the claims as the selected time or a precise time.

The plate 19 as shown in FIG. 5 can be seen to be a circular disc which has two holes, 30 and 31, passing through the plate. Hole 30 forms the engine's first exhaust valve, while hole 31 forms the engine's first intake valve. Although a disc is one shape other shapes for plate 19 can be used and are considered equivalent. Plate 19 rotates about its center 32 while theses holes pass between the lines carrying the intake and exhaust gases allowing these gases to pass through the holes at appropriate time to permit the engine to function properly.

Note in FIG. 4 that the intake line 24 carrying an air-fuel mixture from the carburetor is placed directly over the engine's input port 25 with only the plate 19 separating the input line and the engine's input port. The hole 31 in plate 19 is placed at a radial distance from plate nineteen's center 32 so that this hole will pass between line 24 and port 25, and thereby provide a path for the air-fuel mixture to enter the engine's intake for as long as the hole 31 remains between line 24 and port 25. The period of time that the air-fuel mixture is admitted to the engine is determined by the size of the hole and the speed of rotation of shaft 19.

The holes in plate 19 can take on different shapes to achieve different operating times for the valves. For example, FIG. 6 shows plate 19 again, only there is a second and elongated exhaust valve hole 34 and a second and elongated intake valve hole 33.

Figure 6:
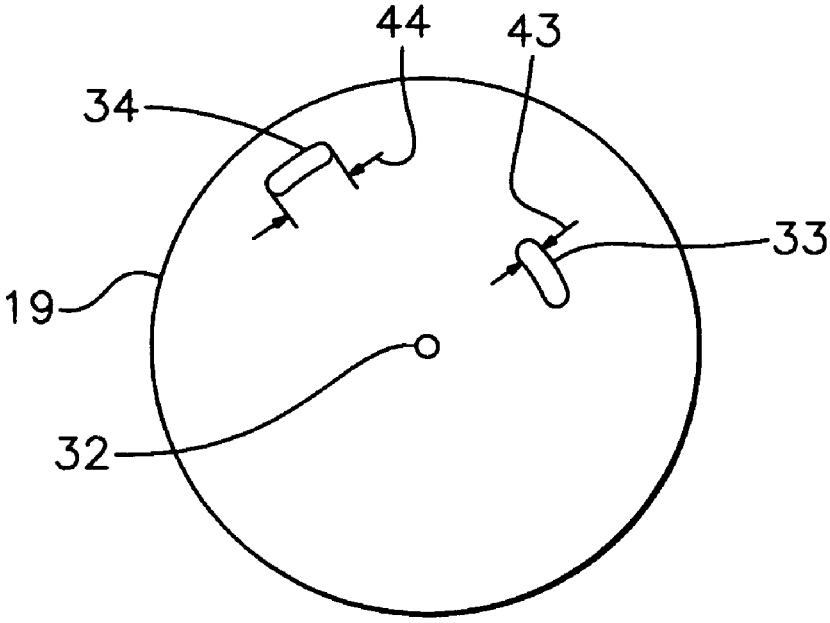
FIG. 6 is a plan view of the rolling valves with elongated valve ports.

To take greater advantage of such larger holes in plate 19 as is shown in FIG. 6, a line, such as line 24, and a port, such as port 25, may also be elongated to encompass the elongated holes in plate 19 for a longer period. The holes when elongated have a width 43 and a length 44. The width is determined by the valve opening required to pass the gas. The length and the speed of rotation determine how long the valve is open.

The description above concerning the holes in plate 19 and their general operation for the intake line 24 and intake port 25 is generally applicable to the operation of the systems exhaust port 14, and the engine's exhaust port 26, only it is the engine's exhaust gas that is passing from the engine exhaust port to the system exhaust port 14, rather than from intake line 24 to input port 25. That is, the exhaust gases emanating from engine exhaust port 26 pass through hole 30 in plate 19 to system exhaust port 14 when hole 30 is positioned between port 26 and system exhaust port 14.

The speed of rotation of plate 19 is determined by the speed of drive shaft 13 and the ratio of the diameters of timing gear 17 and plate 19. The ratio of the diameters can be adjusted to have the holes in plate 19 in the appropriate location to cause the engine to perform properly as discussed in connection with Table II. For example, when the piston is about to begin the up stroke, hole 31 is positioned between line 34 and input port 25 to admit the air-fuel mixture from the carburetor to the engine's cylinder. Although plate 19 is shown in FIG. 4 to be generally held in a horizontal plane for ease of description in these specifications and in the claims, it is understood that the plate may be oriented in any plane and function equally well. Orientation other than horizontal are considered equivalent and are included within the spirit and scope of the invention.

It should be noted that fan 21 is alternatively referred to as a fan or compressor because any similar device, including a turbine, which can compress air may be suitable for this function. The function of the fan is primarily to compress air which is fed through line 23 to the carburetor 22. Carburetor 22 accepts the compressed air and mixes it with fuel. The fuel is delivered to the carburetor through fuel line 27. The air-fuel mixture is then fed through line 24 through hole 31 in rotating valve plate 19 to the engine intake port 25 where the compressed air-fuel mixture, first purges the cylinder and then fills the cylinder with the air fuel mixture to charge the cylinder with an explosive air fuel mixture for the power stroke.

The compressor in the present invention may serve a second function as a supercharger which increases the horse power of the engine considerably. A supercharger for a gasoline engine is principally a turbine placed before the carburetor to force a larger charge of air and fuel into the cylinder than would ordinarily occur without the supercharger. The compressor in the present invention is already in a position in the air supply line to the engine that is before the carburetor. It merely has to be adjusted to optimizer the correct air pressure and volume of air to the engine to obtain the supercharger effect.

The linkage used to drive the fan is only one of many possible ways to drive the fan. An obvious alternative is to have the drive shaft drive an electric generator which is used to drive an electric motor which in turns drives the fan. The electric motor can be more easily varied in speed as is necessary to obtain optimum turbo-charged performance and it's speed may be computer controlled to provide optimum outputs which cannot be obtained from a fixed ratio gear train.

Many other variations of the basic invention will be obvious to those skilled in the art after reviewing this disclosure and therefore such variations are considered within the spirit and scope of the invention. For example, in a second embodiment, rather then using an air-fuel mixture to purge the cylinder, the cylinder can be purged with air only by using a line 36, shown in FIG. 4, which goes directly from the output of the fan to plate 19. Plate 19 includes another hole 41 shown in FIG. 5 which allows only air into the cylinder to purge the cylinder before the air fuel mixture is fed into the cylinder. Line 36 is over hole 41 prior to the admittance of the air fuel mixture and accepts air under pressure to the engine inlet port to purge the cylinder of exhaust gases. This will improves efficiency by preventing fuel from being ejected from the cylinder during purging. Hole 41 in plate 19 constitutes an air purging valve with an inlet and outlet port. The inlet port is formed by the lower end of line 36 which is in contact with plate 19 and the outlet of the air purging valve is formed the upper end of line 42 which goes from the plate 19 to the engine's cylinder input.

The operation of the engine in the first embodiment of the present invention is in many ways similar to prior art two stroke-engines with the air-fuel mixture being used partially to purge exhaust fumes from the cylinder and also to supply an explosive mixture to the cylinder in preparation for the power stroke. The differences between prior art two stroke engines and the first embodiment of the present invention are the air fuel mixture is compressed in the compressor rather than in the crankcase and it is injected into the cylinder through conduit line 24 and the rolling plate 19, eliminating the need for a bypass.

One of the principal advantage of the present invention is the elimination of the need to mix oil and fuel to lubricate the engine. This system allows the supplying of oil separately to the engine crank case which is a great convenience during fueling. Another advantage is the reduction in carbon build-up due to the elimination of the burning of lubricating oil. This latter advantage extends the life of the engine. Still another advantage is the fine tuning of the engine through the shaping of the intake and exhaust ports which can be elongated, tear shaped or shaped otherwise to control the timing, rate and amount passed to or from the engine. An elongated valve port in plate 19 is shown in FIG. 6 where elongated ports 33 and 34 are shown. This is another feature which improves efficiency and is not easily obtained by conventional valves.

Figure 7:
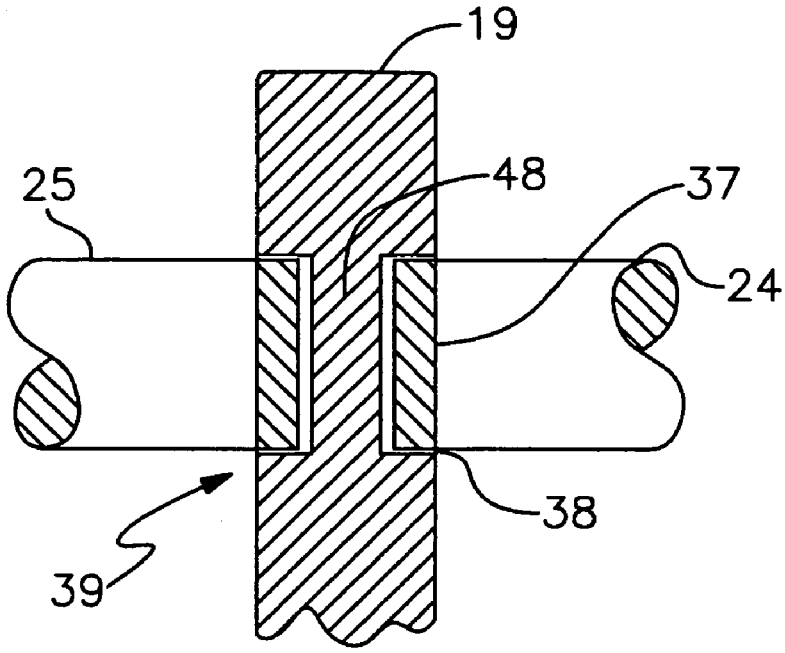
FIG. 7 is a side cross sectional view of a rolling valve using a recess in the plate and extension plates about the lines to the rolling valves to reduce unwanted leakage about the valves.
Figure 8:
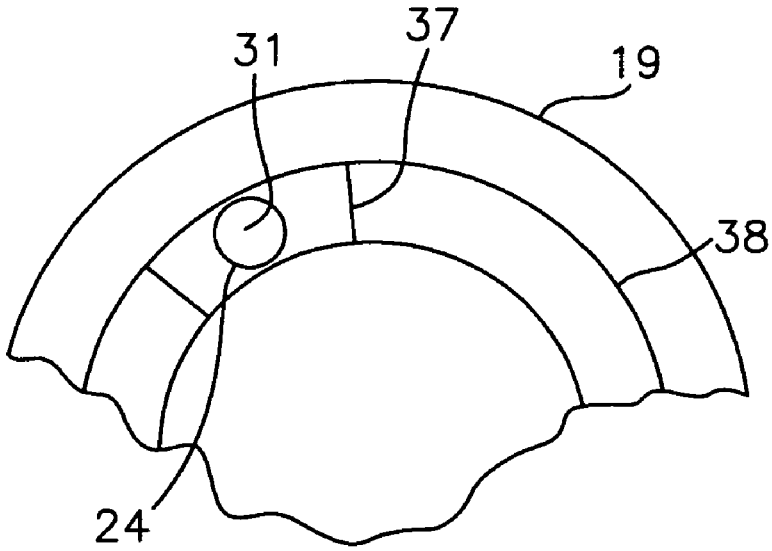
FIG. 8 is a right side view of a rolling plate carrying a recess and containing an extension plate in the recess.

To reduce leakage about the rolling valves, greater contact area about the lines and the rolling plate can be achieved by the arrangement shown in FIGS. 7 and 8. FIG. 7 is a side cross sectional view of a rolling valve using a circular recess 38 in the plate 19 about line 24 and an extension plate 37 which rides in the recess and is attached about line 24. The extension plates are shaped to fit within the circular recess as shown.

FIG. 8 is a side view of the arrangement shown in FIG. 8. It can be seen that the extension plate extends the coverage by the line 24 over plate 19 and also aids in preventing leakage from elongated holes that are longer than the diameter of line 24.

Having described my invention, I claim the following:

1. A rolling valve for use in an internal combustion engine, said engine including a cylinder containing an inlet and an outlet port, comprising:

(a) a rolling plate having a top, a bottom, a center and a central axis of rotation passing though said center of said plate and said axis being generally orthogonal with the top and bottom of said plate, (b) connecting means for connecting said rolling plate to said engine to cause said plate to revolve at a speed which is a selected function of the engine speed, (c) a rolling plate port passing from the top to the bottom of said rolling plate, (d) a rolling plate input connecting means having a first and a second end, said first end being connected to a source and said second end being in sliding contact with the top of said rolling plate and positioned to be over and cover said rolling plate port at least once during each revolution of said plate to accept a gas from said source and deliver it to said rolling plate port, and (e) a rolling plate output connection means having a first and a second end, said first end being connected to a receiver and said second end being in sliding contact with the bottom of said rolling plate and positioned to be directly below said second end of said rolling plate input connection means and to be also under and cover said rolling plate port at the same time that said rolling plate input connecting means is above said rolling plate port during each revolution to transmit a gas from said source to said receiver at a precise time in the engine cycle.

2. A rolling valve as claimed in claim 1 wherein said engine further includes a means for compressing air and said source is said means for supplying compressed air and said receiver is the engine cylinder's inlet port to apply compressed air to the engines cylinder to purge spent gas from the cylinder at a precise time in the engine cycle.

3. A rolling valve as claimed in claim 1, wherein said engine further includes a means for mixing air with fuel and said source is said means for mixing air with fuel and said receiver is said cylinder inlet port to deliver an air-fuel mixture to said cylinder at a precise time in the engine cycle.

4. A rolling valve as claimed in claim 1, wherein said engine further includes an exhaust port and said source is the outlet port of the cylinder and the receiver is said exhaust port to deliver exhaust gas from the cylinder to the exhaust port at a precise time in the engine cycle.

5. An rolling valve as claimed in claim 1, wherein said rolling plate contains multiple ports and each port has its own input connecting means, output connecting means, source and receiver to enable a single rolling valve to function as a multiple valve for multiple sources and receivers.

6. A rolling valve as claimed in claim 1, wherein said rolling plate port is circular.

7. A rolling plate valve as claimed in claim 1, wherein said rolling plate port is elongated to provide for an increased open state time than can be obtained with a circular opening of the same width.

8. A rolling valve as claimed in claim 2 further including an extension plate extending generally radially about said input connecting means at its second end to provide greater coverage over the rolling plate port and to accommodate elongated rolling plate ports.

9. A rolling valve as claimed in claim 1, further including a first annular recess located in the top of said rolling plate and centered about said rolling plate center to accept and closely fit about said rolling plate input connecting means to reduce leakage from said input connecting means.

10. A rolling valve as claimed in claim 2, further comprising a second annular recess located in the bottom of said rolling plate and centered about said rolling plate center to accept and closely fit about said rolling plate output connecting means to reduce leakage from said output connecting means.

* * * * *